US005970991A

United States Patent [19]

Srivastava

[11] Patent Number: 5,970,991

[45] Date of Patent: Oct. 26, 1999

[54] CHIGNON MAKER

[76] Inventor: Priti Srivastava, 201 Eagle Bay Dr., Ossining, N.Y. 10562

[21] Appl. No.: 09/148,352

[22] Filed: Sep. 4, 1998

[51] Int. Cl.[6] ..... A41G 3/00; A41G 5/00; A45D 24/00; A45D 8/40

[52] U.S. Cl. ..... 132/274; 132/53; 132/56; 132/55; 132/200

[58] Field of Search ..... 132/274, 273, 132/53, 54, 55, 56, 200

[56] References Cited

U.S. PATENT DOCUMENTS

| | | | |
|---|---|---|---|
| 2,524,255 | 10/1950 | Goldsmith | 132/49 |
| 2,765,798 | 10/1956 | Carvell | 132/55 |
| 3,556,115 | 1/1971 | Benson | 132/274 |
| 3,693,637 | 9/1972 | Sidelman | 132/55 |
| 3,842,849 | 10/1974 | Goodman | 132/46 R |
| 4,648,414 | 3/1987 | Fox et al. | 132/43 R |
| 5,472,003 | 12/1995 | Frame et al. | 132/275 |
| 5,494,059 | 2/1996 | Barrows | 132/273 |
| 5,595,199 | 1/1997 | Solomon et al. | 132/273 |
| 5,694,750 | 12/1997 | Allen | 54/78 |

*Primary Examiner*—John J. Wilson
*Assistant Examiner*—Robyn Doan

[57] ABSTRACT

A chignon maker utilizing a cylindrical sleeve open at both ends. A captive rubber band surrounds one end to elasticize it. In use, the wearer pulls the cylindrical sleeve over her pony-tail so as to completely enclose the pony-tail with the elasticized end positioned at the base of her pony-tail. The wearer then twists the sleeve along with the enclosed pony-tail in an action similar to the action of wringing a towel. Subsequently, the wearer wraps the twisted sleeve in a spiral fashion around the base of her pony-tail thereby forming a chignon. The chignon is secured in place by tucking the non-elasticized end of the sleeve into the base of the pony-tail.

3 Claims, 4 Drawing Sheets

CHIGNON MAKER

FIELD OF THE INVENTION

This invention relates generally to hair-styling equipment and more specifically to a novel means for making chignons.

DESCRIPTION OF PRIOR ART

Prior art devices for making chignons have one or more of the following shortcomings:

1. Majority of the devices do not work well with layered hair-styles. In a layered hair-style, the wearer's hair ends at different lengths. Attempting to use prior art devices to make a chignon with a layered hair-style causes a number of loose strands to escape from the chignon. The use of a hair-net to contain said loose strands causes the spiral look of a chignon to be hidden thereby detracting from the overall appearance of the chignon.
2. Most prior art devices require the wearer's pony-tail to be minimally about 6.0 inch long. This precludes wearers with short pony-tails, for example a 2.0 inch pony-tail, from wearing their hair in a chignon.
3. Additionally, most prior art devices require the use of several hair-pins for anchoring a chignon to a wearer's head. The use of hair-pins is not only inconvenient, but it also adds a potential for hurting the wearer's scalp either through scratching or, in extreme cases, through puncturing the wearer's skin.
4. Most prior art devices require a highly skilled person to make an elegant and stable chignon.
5. Many prior art devices for making chignons are bulky and difficult to carry in a wearer's handbag.

OBJECTS AND ADVANTAGES

Accordingly, several objects and advantages of the present invention are to provide a chignon maker that will overcome the shortcomings of the prior art devices.

An object of this invention is to provide a chignon maker for wearers with layered hair-cuts. The disadvantage of most prior art devices when applied to layered hair-cuts is that unattractive loose strands of hair escape out of the chignon. Prior art devices further result in unstable chignons due to their inability to confine all the loose strands into the chignon. The present invention keeps stray hair confined while still maintaining the spiral appearance of a chignon.

Another object of this invention is to provide a device that enables wearers with short hair-lengths to wear their hair in chignons. The only constraint is that the wearers be able to pull their hair into a pony-tail. So even if the pony-tail length is as small as 2.0 inch, the current invention will still allow the wearer to make a stable chignon.

A further object of this invention is to provide a device that allows the wearer to make a stable chignon. The invention does not require any hair-pins for securely anchoring the said chignon.

Another object of this invention is to provide a device that consists of a cylindrical piece of flexible sleeve that is slipped over a pony-tail so as to completely contain the pony-tail. The sleeve is subsequently twisted, wrapped in a spiral fashion, and secured on the wearer's head, thereby forming an elegant and stable chignon.

An additional object of this invention is to provide a device that enables the spiral structure of the chignon to show.

Yet another object of this invention is to provide a device that adds another item to be utilized as a wearer's hair accessory. Depending upon the materials employed and additional decorations used, the chignon maker can result in a variety of looks including professional day-time hair-styles and elegant, evening looks.

A further object is to provide a chignon making device that is simple and easy to use.

A still further object is to provide a chignon making device that is economical in cost to manufacture.

Another object of the invention is to provide a means for protecting the wearer's hair.

Yet another object of the invention is to provide a device for making chignons that can easily fit into a lady's handbag without adding any ungainly bulk or bulges to it.

Further objects and advantages of this invention will become apparent from a consideration of the drawings and the ensuing description.

DRAWING FIGURES

REFERENCE NUMERALS IN DRAWINGS

Figure 1A:
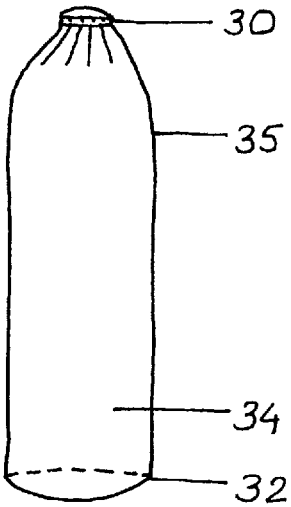
FIGS. 1A and 1B are the front and top views, respectively, of a chignon maker representing the presently preferred embodiment of the invention.

| | |
|---|---|
| 30 | elasticized end of sleeve |
| 32 | end of sleeve |
| 34 | sleeve |
| 35 | chignon maker |
| 36 | end of sleeve |
| 37 | twisted sleeve |
| 38 | rubber band |
| 39 | direction of twisting |
| 40 | wearer |
| 42 | pony-tail |
| 44 | pony-tail base |
| 48 | chignon |
| 50 | top-knot |
| 53 | side-chignon |

-continued

| | |
|---|---|
| 54 | side-chignon |
| 55 | twisted sleeve |
| 56 | twisted sleeve |
| 57 | pony-tail base |
| 58 | pony-tail base |
| 59 | pre-elasticized end |

Summary

In accordance with the present invention a chignon maker comprises a cylindrical sleeve of flexible material that can be readily twisted and wrapped, a holding means for securing one end of the sleeve to the base of a wearer's pony-tail, and a length of sleeve that extends beyond the length of the pony-tail and that can be tucked into the base of the pony-tail to secure the chignon on the wearer's head.

Description

Various aspects of the present invention will evolve from the following detailed description of the currently preferred embodiment thereof which should be taken in conjunction with the prior described drawings.

FIGS. 1 through 16 illustrate a chignon maker 35 for a pony-tail 42 on the head of a wearer 40. Chignon maker 35 consists of a tubular or cylindrical sleeve 34 with a holding means 30 for attaching the top portion of chignon maker 35 to a base 44 of pony-tail 42.

Figure 2:
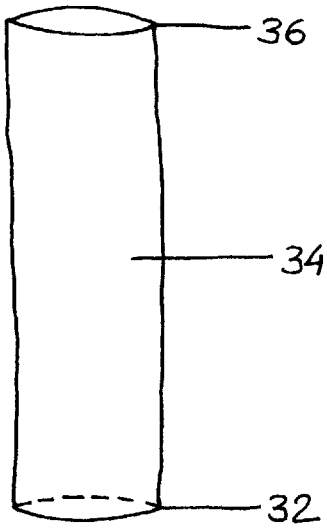
FIG. 2 shows a front view of a tubular or cylindrical sleeve. The said sleeve is open at both ends.
Figure 3:
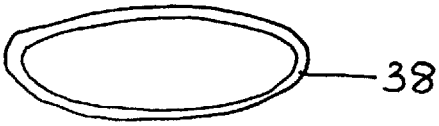
FIG. 3 shows an enlarged, perspective view of a rubber band.

Sleeve 34 is approximately 12.0 inch in length and about 1.5 inch in diameter. In the currently preferred embodiment of the chignon maker, sleeve 34 is made of a sheer, stretch material such as that used in fish-net stockings, pantyhose, lingerie, or other knit material. Sleeve 34 has open ends 36 and 32 at its two ends as shown in FIG. 2. FIG. 3 shows an enlarged view of an ordinary rubber band 38, as is often used to make pony-tails. The rubber band should have an un-stretched diameter of approximately 0.5 inch so that it is smaller than the diameter of the base of the pony-tail thereby enabling it to be placed securely over said base of said pony-tail.

Figure 1B:
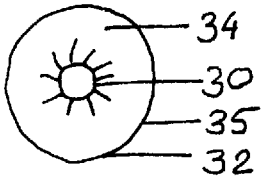
Figure 4:
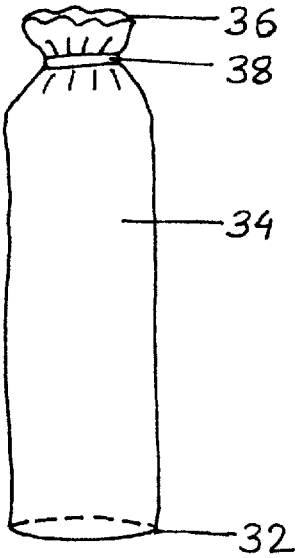
FIGS. 4 and 5 show the first and second steps, respectively, of the presently preferred method of creating the chignon maker.
Figure 5:
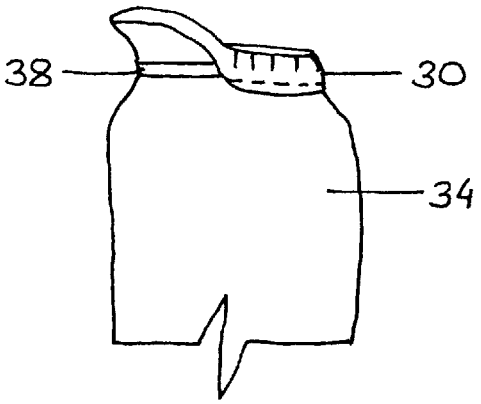

FIGS. 4 and 5 show the method of assembling chignon maker 35 with sleeve 34 and rubber band 38. End 36 of sleeve 34 is inserted, as shown in FIG. 4, through the rubber band 38 until approximately 1.0 inch length of said sleeve protrudes out through the rubber band. This protruding end of sleeve 34 is then folded over rubber band 38 to completely enclose said rubber band and then sewn in place thereby forming an elasticized end 30 as shown in FIG. 5. The completed chignon maker is shown in FIGS. 1 and 2 in front and top views, respectively. The chignon maker may be turned inside-out to hide the fold or it may be used as is.

Figure 6:
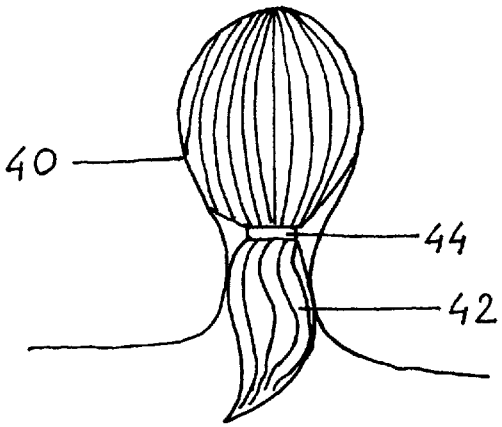
FIG. 6 is a rear view of a wearer's head with a pony-tail.

FIG. 6 shows the rear view of the head of wearer 40. The wearer has her hair pulled into pony-tail 42 by means of any commercially available device such as a rubber band. The rubber band forms base 44 of the pony-tail.

Figure 7:
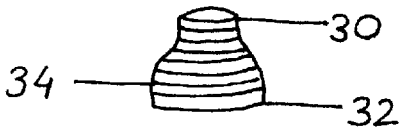
FIG. 7 shows a front view of a collapsed or scrunched chignon maker.
Figure 8:
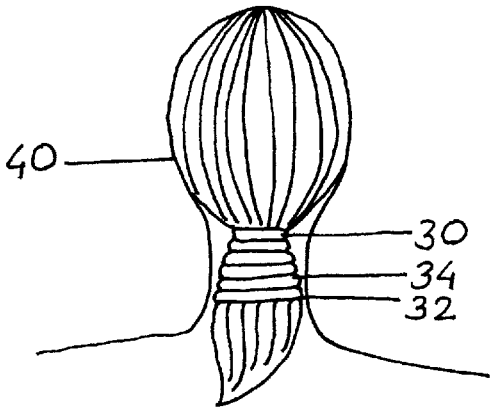
FIG. 8 shows a wearer's pony-tail inserted through the scrunched chignon maker.

FIG. 7 shows a front view of chignon maker 35 with cylindrical sleeve 34 collapsed or scrunched by the wearer so that open ends 30 and 32 of chignon maker 35 are approximately 2.0 inch apart. Said collapsed device is then slipped onto to the wearer's pony-tail as shown in FIG. 8.

Figure 9:
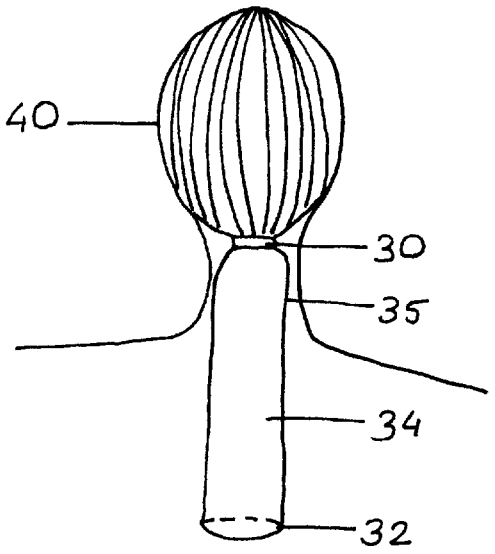
FIG. 9 shows a wearer's pony-tail fully enclosed within the chignon maker after the chignon maker of FIG. 8 has been opened out to its fully relaxed length.

End 30 of device 35 is aligned over pony-tail base 44 of pony-tail 42. Sleeve 34 is then opened out to its original un-collapsed length so as to completely contain pony-tail 42. Pony-tail 42 is thus fully contained in sleeve 34 as shown in FIG. 9. Open end 32 of sleeve 34 hangs loose extending approximately 1.0 inch beyond the end of pony-tail 42.

Figure 10:
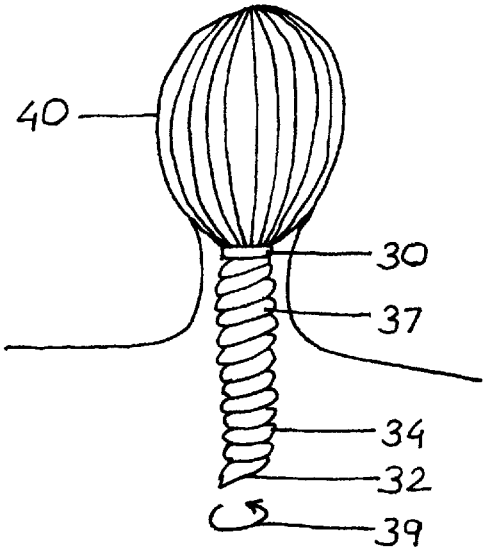
FIG. 10 illustrates a method of twisting the sleeve of the chignon maker along with the enclosed pony-tail.
Figure 11:
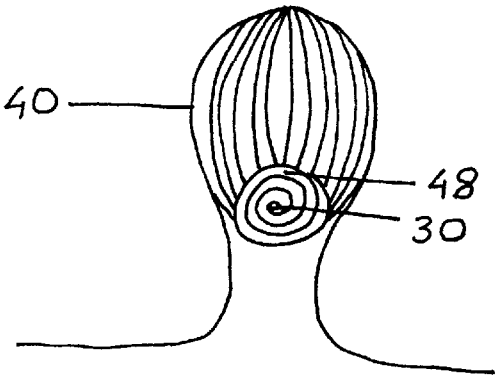
FIG. 11 shows the completed chignon after the twisted sleeve of FIG. 10 has been wrapped in a spiral fashion and secured on the wearer's scalp.

Sleeve 34 along with enclosed pony-tail 42 is firmly grabbed by the wearer and twisted approximately 6 times in an action resembling the wringing of a towel. This action results in a twisted fabric tube 37 as shown in FIG. 10. The twisting action is depicted by an arrow 39 in FIG. 10.

Twisted sleeve 37 is then wrapped tightly in a spiral around pony-tail base 44, close to the wearer's head. Open end 32 is tucked under said spiral and pushed into pony-tail base 44 to secure it. This results in a chignon 48 shown in FIG. 11.

Figure 12:
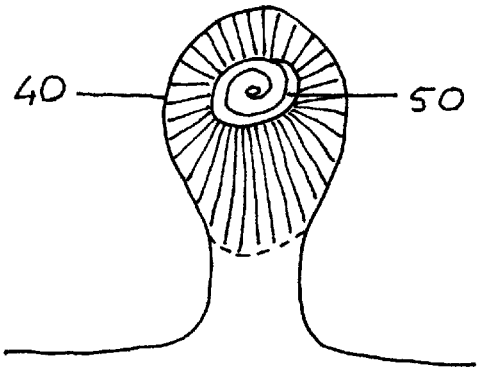
FIGS. 12, 13, 14 and 15 show examples of hair-styles that can be made using one or more chignon makers.

FIG. 12 shows a ramification of the chignon maker. In this case the chignon maker has been used to create a top-knot 50. The only difference between top-knot 50 and chignon 48 is in the higher placement of the pony-tail on the wearer's head.

Figure 13:
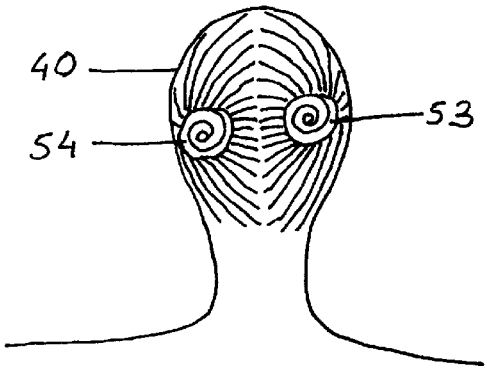

FIG. 13 shows the use of two chignon makers to create a stylish two-chignon hair-style. The wearer first parts her hair in the center to make two pony-tails, one near each ear. The wearer then makes a chignon with each pony-tail as shown in FIGS. 7 through 11. The end result is two-chignons, 53 and 54, as shown in FIG. 13.

Figure 14:
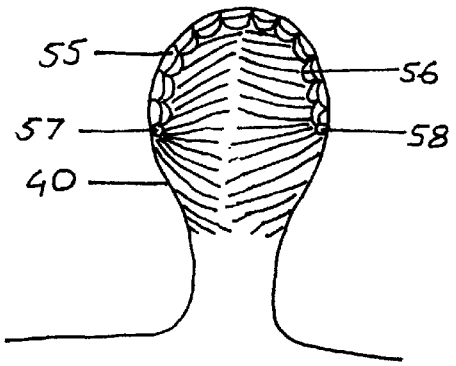

FIG. 14 shows yet another ramification of chignon maker 35. The wearer first makes two pony-tails at pony-tail bases 57 and 58, one near each ear. The wearer then follows the steps shown in FIGS. 7 through 10 for one of the two pony-tails to make a twisted sleeve 55 similar to twisted sleeve 37. Fabric sleeve 55 is then placed on the crown of the wearer's head in the manner of a tiara or a hair-band. Open end 32 of sleeve 55 is tucked into pony-tail base 58. Likewise, a twisted sleeve 56 is made from the second pony-tail. Twisted sleeve 56 is then placed over the crown parallel to twisted sleeve 55. End 32 of sleeve 56 is tucked into base 57. The result is an elegant tiara-style hair shown in FIG. 14.

Figure 15:
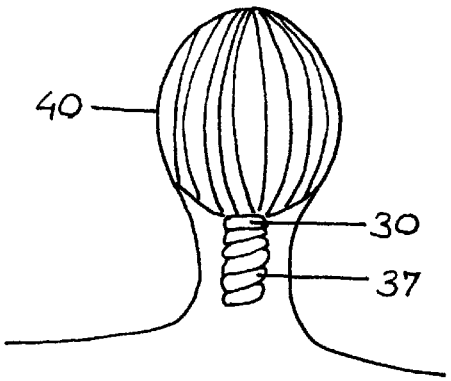

FIG. 15 shows another innovative use of chignon maker 35. Starting with twisted sleeve 37 of FIG. 10, the wearer folds said twisted sleeve in half and tucks open end 32 discreetly into pony-tail base 44.

Figure 16:
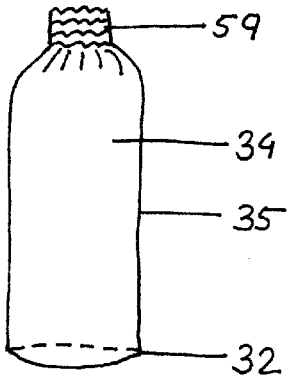
FIGS. 16 is an example of an alternative embodiment of the current invention.

FIG. 16 shows an alternative embodiment of the chignon maker. In this embodiment, end 30 of the chignon maker is elasticized by intrinsic means. In other words, cylindrical sleeve 34 is manufactured with end 30 pre-elasticized as, for instance, the open end of commercially available socks.

The foregoing chignon maker can be created in different colors, fabric textures and materials. Open end 32 may be finished by hemming, trimming or other equivalent means. Fabric sleeve 34 can be created in various lengths depending upon the length of the wearer's hair. Alternatively, wearers may be provided with an option of cutting away any extra length of sleeve based on the lengths of their pony-tails. In the case of materials that unravels easily, the sleeve may include cut-away panels thereby allowing the wearer to cut away discrete lengths without causing the sleeve to unravel.

While, in the foregoing, embodiments of the present invention have been set forth in considerable detail for the purposes of making a complete disclosure of the invention, it may be apparent to those of skill in the art that numerous changes may be made in such details without departing from the spirit and principles of the invention.

Operation of the Invention

To apply chignon maker 35 to wearer's hair the following steps should be taken:

1. Make a pony-tail 42 at the nape of the neck as shown in FIG. 6 using any of a rubber-band, ribbon, pony-tail holder, etc.

2. Choose the right size of chignon maker 35 for the length of the pony-tail. For a pony-tail that is under 6.0 inch in length, the chignon maker should be approximately 8.0 inch long. For a pony-tail that is 6.0 inch or longer in length, the chignon-maker should be about 1.0 inch longer than the pony-tail. Alternatively, you may buy a generic 14.0 inch long chignon maker and then cut it to an appropriate length according to the foregoing guidelines. The extra length of sleeve that extends beyond the pony-tail is used to secure the chignon at the base of the pony-tail.
3. Scrunch or collapse the chignon maker until it forms a 2.0 to 3.0 inch long cylinder. This step, illustrated in FIG. 7 will make it easier to slip the chignon maker onto pony-tail 42 of the wearer.
4. Align elasticized end 30 over pony-tail base 44. The elasticized end should snap into place securely over said rubber band because of its smaller un-stretched diameter.
5. Open cylindrical sleeve 34 to its original length. The cylindrical sleeve should completely enclose the pony-tail. Open end 32 should extend at least an inch beyond the end of the pony-tail.
6. Use one hand to firmly grasp the pony-tail at pony-tail base 44. Use the other hand to twist sleeve 34 along with the enclosed pony-tail thereby forming a twisted sleeve 37. The twisting action is similar to the wringing of a towel. Twist the said sleeve approximately 4 to 8 times depending on the length and thickness of your hair.
7. Wrap twisted sleeve 37 around base 44 in a tight spiral fashion moving outward thereby forming chignon 48. The Chignon should sit flat against the wearer's head.
8. Hold the open end of sleeve 34 firmly between your index finger and thumb. Then gently guide it under the outer circumference of the spiral. Reach under the spiral and tuck end 30 of sleeve 34 into pony-tail base 44. This will secure the chignon in place. No pins are required, but they may be used if desired.
9. Push or tuck open end 32 discreetly into pony-tail base 44 so that it is hidden behind the chignon. Alternatively, you may push open end 32 into the pony-tail base to an extent that any decorations attached to said open end show through the base at the center of chignon 48.

Another ramification of this invention is the top-knot as shown in FIG. 12. To make this ballerina-style chignon, replace foregoing step 1 with the following step:

1. Make a pony-tail high up on the head.

2–9. Follow foregoing steps 2 through 9.

Yet another ramification of the chignon maker is a two-chignon hair-style illustrated in FIG. 13. To create this hair-style proceed as follows:

1. Part the hair centrally and make two pony-tails, one near each ear.

2–9. follow foregoing steps 2 to 9 for each pony-tail.

An additional ramification of the chignon maker is the tiara-like hair-style shown in FIG. 14. To create this hair-style proceed as follows:

1. Part the hair centrally and make two pony-tails at pony-tail bases 57 and 58, one near each ear.

2–6. Pick one pony-tail and follow foregoing steps 2 to 6. A twisted sleeve 55 similar to twisted sleeve 37 results from these steps.

7. Place twisted sleeve 55 tightly over the crown of the wearer's head and tuck open end 32 into base 58 of the pony-tail near the opposite ear. This is illustrated in FIG. 14.
8. Pick second pony-tail and follow foregoing steps 2 to 6. A twisted sleeve 56 similar to twisted sleeve 37 results from these steps.
9. Place twisted sleeve 56 tightly over the crown parallel to twisted sleeve 55. Open end 32 of said sleeve is tucked into pony-tail base 57.

This use will result in a decorative tiara-like hair-style as shown in FIG. 14.

While certain novel features of this invention have been shown and described, it is not intended to be limited to the details above, since it will be understood that various omissions, modifications, substitutions and changes in the forms and details of the device illustrated and its operations can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of the art, fairly constitute essential characteristics of the generic or specific aspects of this invention.

Conclusion, Ramifications, and Scope of the Invention

Accordingly the reader will see that the chignon maker of this invention provides a convenient and reliable device that can be used by wearers of any age to create elegant chignons and other related hair-styles.

Unlike many prior art devices available commercially, the chignon maker allows wearers with layered hair-cuts to wear their hair in chignons. The disadvantage of most prior art devices when applied to layered hair-cuts is that unattractive loose strands of hair escape out of the chignon. The prior art devices further result in unstable chignons due to their inability to confine said loose strands into the chignon. The present invention keeps stray hair confined within the chignon while still maintaining the spiral appearance of the chignon. The chignon maker also provides a device that enables wearers with short hair-lengths to wear their hair in chignons. So even if a wearer's pony-tail length is as small as 1.0 inch, the wearer will still be able to use the current invention to make a stable chignon.

The chignon maker provides a means for creating a stable chignon. The invention does not require any hair-pins for securely anchoring the chignon on the wearer's head.

The chignon maker provides a device that allows the spiral structure of a chignon to show. Many prior art devices use hair-nets that cover up the chignon thereby hiding the attractive spiral structure of said chignon.

The current invention adds another item to be utilized as a wearer's hair accessory. The chignon maker is extremely decorative. Depending upon the materials employed and additional decorations used, the chignon maker can result in a variety of looks including professional, day-time hair-styles and elegant, evening looks.

The chignon maker provides a chignon making device that is simple and easy to use.

The chignon maker is economical in cost to manufacture.

The chignon maker can be scrunched or folded into a small package thereby allowing it to be carried easily in a handbag without adding bulk to it.

The chignon maker also provides a means for protecting the wearer's hair. Additionally, the chignon maker allows the user to add conditioning creams to the pony-tail while preventing the said treated pony-tail from attracting dust.

Although the description above contains many specifics, these should not be construed as limiting the scope of the invention but as merely providing illustrations of some of the presently preferred embodiments of this invention. For example, in an alternative embodiment, the fabric sleeve can be made of a plurality of rectangular pieces sewn together instead of being made of a single continuous piece of fabric. The holding means for securing the sleeve to a pony-tail could be a draw-string or an elasticized lace. Another example of an embodiment of the chignon maker could consist of a single piece of cylindrical, highly elastic material with an un-stretched diameter of approximately 0.5 inch. Such an embodiment of the device would not require any holding means such as a rubber band to hold the chignon maker securely to the pony-tail base. The high elasticity of the material of the sleeve would be sufficient to firmly hold the sleeve at the base of the wearer's pony-tail. Another example of an embodiment of the chignon maker would be to add decorative elements at open end 32 of the chignon maker.

Thus the scope of the invention should be determined by the appended claims and their legal equivalents, rather than by the examples given.

What is claimed is:

1. A method of creating a chignon, said method comprising of the following steps:

a. placing a tubular sleeve of resilient material over the pony-tail of a user, said sleeve comprising of a top open-end and a bottom end, and of a sufficient length to permit the sleeve with the included pony-tail to be wrapped spirally at Least once around the pony-tail base, b. twisting the sleeve along with the enclosed pony-tail;

c. wrapping the twisted sleeve along with the enclosed pony-tail around the base of the pony-tail thereby forming a chignon, d. securing the chignon by means of any of the following: tucking the bottom end of the sleeve into the base of the pony-tail, threading a hair pin through the chignon and the pony-tail base, using a hair-comb to hold the chignon against the wearer's scalp or any equivalent means.

2. The method of claim 1 where the bottom end of the sleeve is tucked into the base of the pony-tail and is then pushed out from the center of the chignon thereby displaying ornamental beads or other decoration that may adorn the bottom end of the tubular sleeve.

3. A method of creating a wrapped hair-style comprising of the following steps:

a. placing a tubular sleeve of resilient material over the pony-tail of a user, said sleeve comprising of a top open-end and a bottom end, and of a sufficient length to permit the sleeve with the included pony-tail to be wrapped spirally at least once around the pony-tail base, b. twisting the sleeve along with the enclosed pony-tail;

c. extending the twisted sleeve along with the enclosed pony-tail over the scalp of the user in any direction;

d. securing the bottom end of the sleeve in the extended position by means of any of the following: tucking the bottom end of the sleeve into the base of a second pony-tail on the wearer's head, anchoring a hair pin into the bottom end of the sleeve, using a hair-comb to hold the bottom end of the sleeve against the wearer's scalp or any equivalent means.

* * * * *